US007481318B2

(12) United States Patent
Bara et al.

(10) Patent No.: US 7,481,318 B2
(45) Date of Patent: Jan. 27, 2009

(54) APPARATUS AND PROCESS FOR COALESCING BITUMEN IN AN OIL SAND SLURRY

(75) Inventors: Barry Bara, Edmonton (CA); Michael Lipsett, Fort McMurray (CA); Waldemar Maciejewski, Edmonton (CA); Samson Ng, Sherwood Park (CA)

(73) Assignees: AEC Oil Sands, L.P., Calgary (CA); Canadian Oil Sands Commercial Trust, Calgary (CA); Canadian Oil Sands Limited, Calgary (CA); Comocophillips Oilsands PartnershipII, Calgary (CA); Imperial Oil Resources, Calgary (CA); Mocal Energy Limited, Tokyo (JP); Murphy Oil Company Ltd., Calgary (CA); Nexen Inc., Calgary (CA); Petro-Canada Oil And Gas, Calgary (CA)

( * ) Notice: Subject to any disclaimer, the term of this patent is extended or adjusted under 35 U.S.C. 154(b) by 446 days.

(21) Appl. No.: 10/685,394

(22) Filed: Oct. 16, 2003

(65) Prior Publication Data

US 2005/0082205 A1 Apr. 21, 2005

(51) Int. Cl.
*B04C 5/24* (2006.01)

(52) U.S. Cl. ..... 209/728; 209/725; 209/18; 210/787; 210/788; 210/800

(58) Field of Classification Search ..... 209/725, 209/728, 18, 172; 210/513, 800, 804, 787, 210/788

See application file for complete search history.

(56) References Cited

U.S. PATENT DOCUMENTS

| | | | | |
|---|---|---|---|---|
| 4,406,793 | A * | 9/1983 | Kruyer | 210/669 |
| 4,626,360 | A * | 12/1986 | Senyard et al. | 210/799 |
| 5,080,792 | A * | 1/1992 | McGovern et al. | 210/512.1 |
| 5,192,423 | A * | 3/1993 | Duczmal et al. | 209/164 |
| 6,119,870 | A * | 9/2000 | Maciejewski et al. | 209/725 |
| 6,190,543 | B1 * | 2/2001 | Christiansen | 210/87 |
| 6,872,239 | B2 * | 3/2005 | Nilsen et al. | 95/30 |
| 7,141,162 | B2 * | 11/2006 | Garner et al. | 210/202 |
| 2005/0082205 | A1 * | 4/2005 | Bara et al. | 209/3 |

* cited by examiner

*Primary Examiner*—Patrick H Mackey
*Assistant Examiner*—Terrell H Matthews
(74) *Attorney, Agent, or Firm*—Millen, White, Zelano & Branigan, P.C.

(57) ABSTRACT

An aqueous aerated oil sand slurry is conditioned in a pipeline and then spun within an elongate vessel of circular cross-section, to cause bitumen droplets in the slurry to coalesce. This increases the probability that the droplets will become aerated by contact with air bubbles. The slurry is then subjected to separation of the sand and bitumen.

20 Claims, 2 Drawing Sheets

APPARATUS AND PROCESS FOR COALESCING BITUMEN IN AN OIL SAND SLURRY

FIELD OF THE INVENTION

The present invention relates to a process for treating an aqueous oil sand slurry to enhance the probability of bitumen droplet contact and coalescence.

BACKGROUND OF THE INVENTION

Oil sand, as known in the Fort McMurray region of Alberta, comprises water-wetted sand grains having viscous bitumen flecks trapped between the grains. It lends itself to separating or dispersing the bitumen from the sand grains by slurrying the as-mined oil sand in heated water so that the bitumen flecks disperse into the aqueous phase.

The bitumen in McMurray oil sand has been commercially recovered at applicant's plant for the past 25 years. Initially this was done using the following general scheme (referred to as the "hot water process"):

- dry mining the oil sand at a mine site that was kilometers from an extraction plant;
- conveying the as-mined oil sand on conveyor belts to the extraction plant;
- feeding the oil sand into a rotating tumbler where it was mixed for a prescribed retention time with hot water (80° C.), steam, caustic and naturally entrained air to yield a slurry typically having a temperature of 80° C. During this operation, bitumen flecks were heated and became less viscous. Chunks or lumps of oil sand were ablated or disintegrated. The sand grains and bitumen flecks were dispersed or separated in the water. To some extent bitumen flecks contacted, coalesced into droplets and grew in size. The bitumen droplets contacted air bubbles and coated them or connected with them to become aerated bitumen. The term used to describe this overall process in the tumbler is "conditioning";
- the slurry produced was then diluted with additional hot water and introduced into a large, open-topped, conical-bottomed, cylindrical vessel (termed a primary separation vessel or "PSV"). The diluted slurry was retained in the PSV under quiescent conditions for a prescribed retention period. During this period, aerated bitumen droplets rose and formed a froth layer. The froth overflowed the top lip of the vessel and was conveyed away in a launder. The sand grains sank and were concentrated in the conical bottom—they left the bottom of the vessel as a wet tailings stream. Middlings, a watery mixture containing solids and relatively non-buoyant bitumen, extended between the froth and sand layers. The term used to describe this step is "spontaneous flotation";
- the tailings and middlings were withdrawn, combined and sent to a secondary flotation process carried out in a deep cone vessel wherein air was sparged into the vessel to assist with flotation. This vessel is referred to as the TOR vessel. It and the process conducted in it are disclosed in U.S. Pat. No. 4,545,892. The bitumen recovered was recycled to the PSV; and
- the middlings from the deep cone vessel were further processed in air flotation cells to recover contained bitumen. The term used to describe the mechanisms in the TOR and air floatation cells are collectively referred to as "secondary flotation".

A fairly recent change with respect to this procedure involved:

- supplying heated water at the mine site;
- pre-crushing the dry, as-mined oil sand, for example to −24 inches;
- mixing the pre-crushed oil sand with the heated water and entraining air, at the mine site, to form a pumpable slurry having a temperature, for example in the order of 50° C.; and
- pumping the slurry through a pipeline directly to a PSV to subject it to spontaneous flotation.

This procedure relies on the mechanisms of conditioning being completed satisfactorily as the slurry moves through the pipeline so that, when the slurry is retained in the PSV, a viable proportion of the contained aerated bitumen reports to the froth layer.

It needs to be understood that the composition and processability of oil sand varies, often significantly. As a consequence, we have noted that, from time to time, the pipelined oil sand slurry produces unsatisfactory primary froth yield in the PSV. We believe that one reason for this may be that the residence time in the pipeline may be too short for that particular oil sand and that the bitumen droplets do not coalesce and grow to a size suitable for aeration and flotation.

SUMMARY OF THE INVENTION

With this background in mind, we have devised an apparatus and process for treating an aqueous aerated oil sand slurry to increase the probability that bitumen droplets will contact and coalesce to grow in size. In addition, small non-aerated droplets may coalesce and grow to a size that will readily aerate.

More particularly:

- an assembly is provided comprising a coalescer and a bitumen/sand separator (such as a PSV or a cycloseparator). These units are operatively connected in series to process a stream of aqueous oil sand slurry;
- the coalescer is an elongate closed vessel forming a chamber having a circular cross-section, the vessel further having means, such as a tangential inlet at its inlet end, for introducing slurry feed and inducing it to rotate about the vessel's longitudinal axis as it advances through the chamber, and an outlet at its other end; slurry is injected under pressure into the vessel chamber through the inlet means with the result that bitumen droplets are caused to move inwardly and to concentrate in the central core of the advancing flow, whereby the bitumen droplets contact, coalesce and grow; and
- the so-treated slurry stream is then expelled through the coalescer outlet and is conveyed through a pipeline into the separator, for separation of sand and bitumen.

DESCRIPTION OF THE PREFERRED EMBODIMENT

Figure 1:
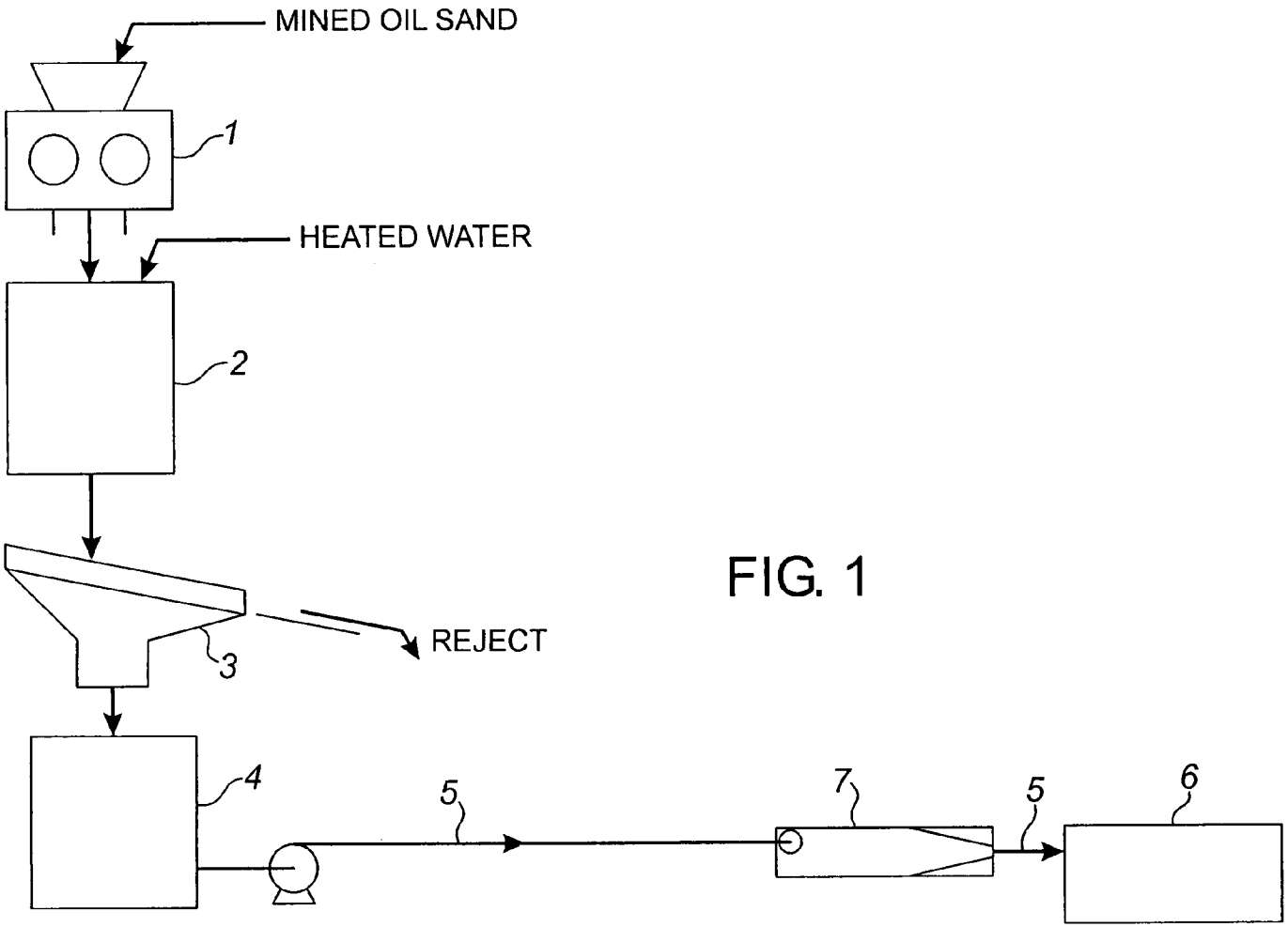
FIG. 1 is a schematic showing a circuit for processing a stream of aqueous, aerated bitumen slurry.
Figure 2:
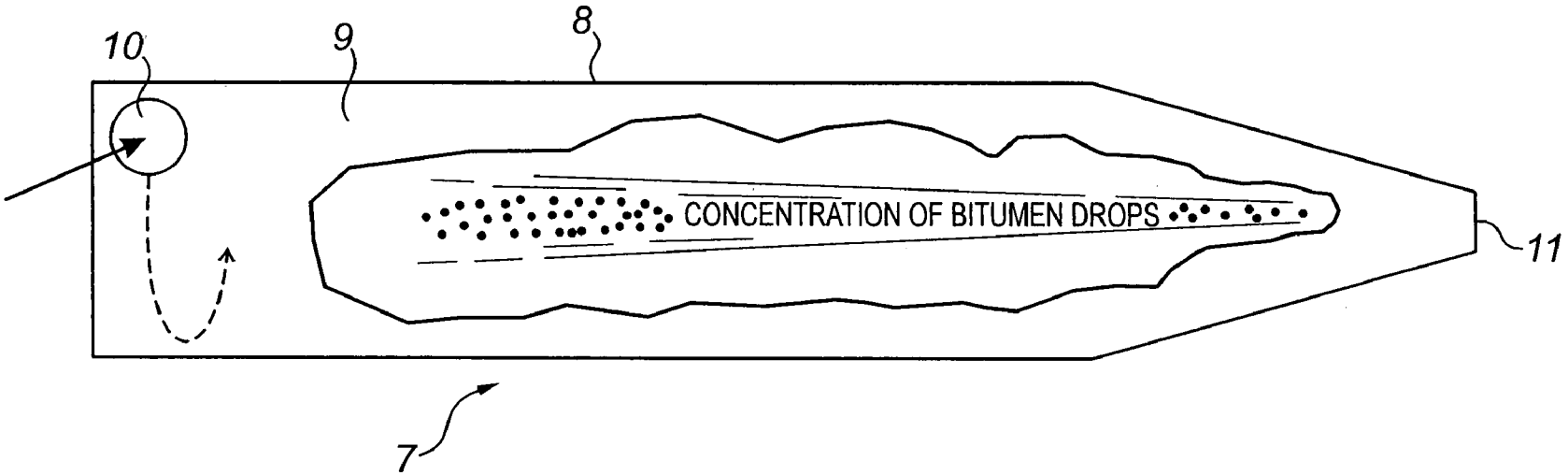
FIG. 2 is a partly broken away side view of the coalescer, forming part of the circuit of FIG. 1, with arrows indicating the slurry flow through the vessel inlet, its rotational flow along its length and its exit through the outlet.

The preparation of slurry, pipelining and bitumen/sand separation of an aqueous oil sand slurry is known technology in the oil sand industry. Typically, the as-mined oil sand is pre-crushed to −24 inches using a double roll crusher 1. The crushed oil sand is then mixed with heated water and air and partly conditioned in a mixer 2. Oversize material is rejected by passing the slurry through a screen 3. The aerated slurry is collected in a pump box 4 and is then pumped through a pipeline 5, thereby advancing conditioning, and is introduced into a sand/bitumen separator 6, such as a cycloseparator.

In accordance with the present invention, a coalescer 7 is connected with the pipeline 5, upstream of the separator 6.

The coalescer 7 is an elongate, closed, preferably cylindrical vessel 8 forming an interior chamber 9 of circular cross-section. The vessel 8 has a tangential inlet 10 at one end. The inlet 10 is connected with the pipeline 5. At its opposite end, the vessel 8 has an outlet 11, preferably axial, which is connected with the separator 6.

In use, pipeline slurry is injected under pressure into the chamber 9 through the tangential inlet 10. The slurry rotates as it proceeds to advance longitudinally through the chamber 9. Under the influence of centrifugal force, the lighter bitumen and water migrate inwardly and the heavier sand migrates outwardly. The entire stream, now somewhat stratified, is expelled through the outlet 11 and is introduced back into the pipeline 5 and eventually into the separator 6 for separation of the bitumen and sand.

By centrally concentrating the bitumen droplets in the stream moving through the coalescer 7, a greater opportunity or probability is provided whereby the individual bitumen droplets may contact, coalesce and grow into larger droplets better able to unite with air bubbles to form buoyant bitumen. As a result, the performance of the separator 6 may be enhanced.

Although a preferred embodiment has been shown and described, it will be appreciated by those skilled in the art that various changes and modifications might be made without departing from the scope of the invention, as defined in the appended claims.

The embodiments of the invention in which an exclusive property or privilege is claimed are defined as follows:

1. A continuous process for treating a stream of aqueous aerated oil sand slurry containing bitumen droplets and sand and separating it in a separator, comprising:

providing an elongated closed vessel forming a chamber having a circular cross-section and a longitudinal axis, said vessel having an inlet at one end and an outlet at its other end;

injecting the slurry stream through the inlet to cause the slurry to rotate as it advances longitudinally through the chamber, so that under centrifugal force bitumen droplets move inwardly toward the chamber axis and are concentrated, thereby increasing the probability of bitumen droplet contact, coalescence and growth, and producing a treated slurry stream;

expelling the treated slurry stream through the vessel outlet; and introducing the expelled treated slurry stream into the separator, separating the sand from the bitumen, and recovering resultant separated bitumen.

2. The process as claimed in claim 1 wherein the separator comprises a gravity separation vessel.

3. The process as claimed in claim 1 wherein the separator comprises a cyclonic separator.

4. The process as claimed in claim 1 whereby the slurry stream is injected into the elongated closed vessel under pressure.

5. The process as claimed in claim 1 whereby the treated slurry stream is introduced into the separator by means of a pipeline operatively connected to the vessel outlet.

6. An assembly for treating a stream of aqueous aerated oil sand slurry containing bitumen droplets and sand and then separating out the bitumen from the sand, comprising:

an elongated closed vessel forming a stationary chamber having a circular cross-section and a longitudinal axis, said vessel consisting essentially of an inlet at one end, for introducing the slurry stream into the vessel to cause the slurry stream to rotate about the vessel's longitudinal axis, and an outlet at its other end, for expelling treated oil sand slurry; and a separator operatively connected to the vessel for receiving the treated oil sand slurry and separating out the bitumen from the sand contained in the slurry.

7. The assembly as claimed in claim 6 wherein the separator comprises a gravity separation vessel.

8. The assembly as claimed in claim 6 wherein the separator comprises a cyclonic separator.

9. The assembly as claimed in claim 6 wherein the separator is operatively connected to the vessel by means of a pipeline.

10. A process according to claim 1, wherein the entire injected slurry stream is expelled through the vessel outlet.

11. A process according to claim 1, comprising a step preceding the injection of the slurry stream into the coalescer vessel, said preceding step comprising passing the slurry through a conditioning pipeline.

12. A process according to claim 11, wherein the entire injected slurry stream is expelled through the vessel outlet.

13. A process according to claim 1, wherein the bitumen droplets coalesce and grow in size sufficient to aerate said droplets.

14. A process according to claim 1, wherein the inlet is tangential to the longitudinal axis.

15. An assembly according to claim 6, wherein the inlet is tangential to the longitudinal axis.

16. A process according to claim 1, wherein said elongated closed chamber is stationary.

17. A process according to claim 14, wherein said elongated closed chamber is stationary.

18. A process according to claim 1, wherein the entire contents of said vessel is continuously expelled through the vessel outlet.

19. A process according to claim 14, wherein the entire contents of said vessel is continuously expelled through the vessel outlet.

20. A process according to claim 17, wherein the entire contents of said vessel is continuously expelled through the vessel outlet.

* * * * *

UNITED STATES PATENT AND TRADEMARK OFFICE

CERTIFICATE OF CORRECTION

PATENT NO. : 7,481,318 B2
APPLICATION NO. : 10/685394
DATED : January 27, 2009
INVENTOR(S) : Bara et al.

It is certified that error appears in the above-identified patent and that said Letters Patent is hereby corrected as shown below:

On the Title Page, Item (75) Change "Fort McMurray (CA)" to --Edmonton (CA)--.

Item (73) Change "Comocophillips Oilsands" to --ConocoPhillips Oilsands--.

Signed and Sealed this
Tenth Day of May, 2011

David J. Kappos

David J. Kappos
*Director of the United States Patent and Trademark Office*